US007898370B2

(12) United States Patent
Zhou et al.

(10) Patent No.: US 7,898,370 B2
(45) Date of Patent: Mar. 1, 2011

(54) HYBRID SURFACE MOUNTABLE PACKAGES FOR VERY HIGH SPEED INTEGRATED CIRCUITS

(75) Inventors: Jianying Zhou, Acton, MA (US); Yuheng Lee, San Jose, CA (US)

(73) Assignee: Finisar Corporation, Sunnyvale, CA (US)

( * ) Notice: Subject to any disclaimer, the term of this patent is extended or adjusted under 35 U.S.C. 154(b) by 203 days.

(21) Appl. No.: 12/340,375

(22) Filed: Dec. 19, 2008

(65) Prior Publication Data

US 2009/0160583 A1 Jun. 25, 2009

Related U.S. Application Data

(60) Provisional application No. 61/015,542, filed on Dec. 20, 2007.

(51) Int. Cl.
*H01P 3/08* (2006.01)
*H01P 5/00* (2006.01)

(52) U.S. Cl. ..... 333/248; 333/246; 333/260

(58) Field of Classification Search ..... 333/115, 333/117, 236, 238, 239, 248, 26, 246, 260
See application file for complete search history.

(56) References Cited

U.S. PATENT DOCUMENTS 6,624,508 B2 * 9/2003 Koh ..... 257/692
6,674,347 B1 * 1/2004 Maruhashi et al. ..... 333/238
6,774,748 B1 * 8/2004 Ito et al. ..... 333/247

OTHER PUBLICATIONS

Yasutake, Hirachi et al., Status of millimeter-wave MMIC's and their applications in Japan, Oct. 2000, Microwave Conference, 30th European, 4 pages.*
Maruhashi, K et al., 60GHz-Band Flip-Chip MMIC Modules for IEEE1394 Wireless Adapters, Sep. 2001, Microwave Conference, 31st European, 4 pages.*
MSA Reference Document for 300 Pin and 40Gb Transponder, Jul. 2002, MSA, Edition 3, 38 pages.*

* cited by examiner

*Primary Examiner*—Dean O Takaoka
(74) *Attorney, Agent, or Firm*—Workman Nydegger

(57) ABSTRACT

In one example, a hybrid surface mountable package includes a housing at least partially defining a sealed cavity, two microwave integrated circuits (MIC) chips positioned inside the sealed cavity, and a very-high-speed interconnect connecting the two MIC chips to each other. The very-high-speed interconnect includes strong coupling co-planar waveguide (CPWG) transmission lines.

13 Claims, 7 Drawing Sheets

HYBRID SURFACE MOUNTABLE PACKAGES FOR VERY HIGH SPEED INTEGRATED CIRCUITS

CROSS-REFERENCE TO A RELATED APPLICATION

The present application claims priority from U.S. Provisional Patent Application Ser. No. 61/015,542, filed Dec. 20, 2007 and entitled "VERY-HIGH-SPEED SURFACE MOUNTABLE PACKAGES FOR MULTIPLE MICROWAVE INTEGRATED CIRCUITS," which is incorporated herein by reference in its entirety.

BACKGROUND

Surface mountable packages with grid array technology have been widely used for high-speed integrated circuits. Most grid array technologies, such as land grid arrays (LGAs), are generally only applied to 10 Gbps integrated circuits because of bandwidth limitations of the interconnections between the grid arrays and the integrated circuits. However, very-high-speed integrated circuits, also known as microwave integrated circuits (MICs), require very-high-speed interconnects, which are defined herein as interconnects capable of speeds higher than about 25 Gbps.

For some applications, multiple co-packaged MIC chips are required due to the difficulty, loss of performance, and cost entailed in integrating all required functions into a single MIC chip. However, communication between the co-packaged MIC chips has proven problematic due to unfavorable RF/microwave performance and cavity resonances, and spurious modes in the operating frequency.

BRIEF SUMMARY OF SOME EXAMPLE EMBODIMENTS

In general, example embodiments of the present invention relate to hybrid surface mountable packages. The example hybrid surface mountable packages each include multiple co-packaged microwave integrated circuits (MICs) that are connected with very-high-speed interconnects that exhibit favorable RF/microwave performance and cavity resonances and few or no spurious modes in the operating frequency.

In one example embodiment, a hybrid surface mountable package includes a housing at least partially defining a sealed cavity, two MIC chips positioned inside the sealed cavity, and a very-high-speed interconnect connecting the two MIC chips to each other. The very-high-speed interconnect includes strong coupling co-planar waveguide (CPWG) transmission lines.

In another example embodiment, a hybrid surface mountable package includes a housing at least partially defining a sealed cavity, two MIC chips positioned inside the sealed cavity, two microwave connectors positioned outside the cavity, and a very-high-speed interconnect connecting the MIC chips to the microwave connectors. The very-high-speed interconnect includes a strong coupling wall feed thru extending through the housing, first strong coupling CPWG transmission lines connecting the feed thru to the microwave connectors, and second strong coupling CPWG transmission lines connecting the feed thru to the MIC chips.

In yet another example embodiment, a hybrid surface mountable package includes a first housing at least partially defining a first sealed cavity, a second housing at least partially defining a second sealed cavity, first MIC chips positioned inside the first sealed cavity, second MIC chips positioned inside the second sealed cavity, two microwave connectors positioned outside the cavity, and a very-high-speed interconnect connecting the MIC chips to the microwave connectors. The very-high-speed interconnect includes a first strong coupling wall feed thru connecting the first MIC chips and the second MIC chips through the first housing and the second housing, a second strong coupling wall feed thru extending through the second housing, first strong coupling CPWG transmission lines connecting the second feed thru to the microwave connectors, and second strong coupling CPWG transmission lines connecting the second feed thru to the second MIC chips.

BRIEF DESCRIPTION OF THE DRAWINGS

To further clarify certain aspects of example embodiments of the invention, a more particular description of the invention will be rendered by reference to example embodiments thereof which are disclosed in the appended drawings. It is appreciated that these drawings depict only example embodiments of the invention and are therefore not to be considered limiting of its scope nor are they necessarily drawn to scale. Aspects of example embodiments of the invention will be described and explained with additional specificity and detail through the use of the accompanying drawings in which.

DETAILED DESCRIPTION OF SOME EXAMPLE EMBODIMENTS

Example embodiments of the present invention relate to hybrid surface mountable packages. The example hybrid surface mountable packages each include multiple co-packaged microwave integrated circuits (MICs) that are connected to each other with very-high-speed interconnects that exhibit favorable RF/microwave performance and cavity resonances and few or no spurious modes in the operating frequency. The term "high-speed" as used herein refers to speeds below about 25 Gbps, such as 10 Gbps. The term "very-high-speed" as used herein refers to speeds of about 25 Gbps or above, such as 40 Gbps. The term "co-packaged" as used herein refers to multiple integrated circuit chips being packaged in the same sealed cavity.

I. Example Environment

Figure 1:
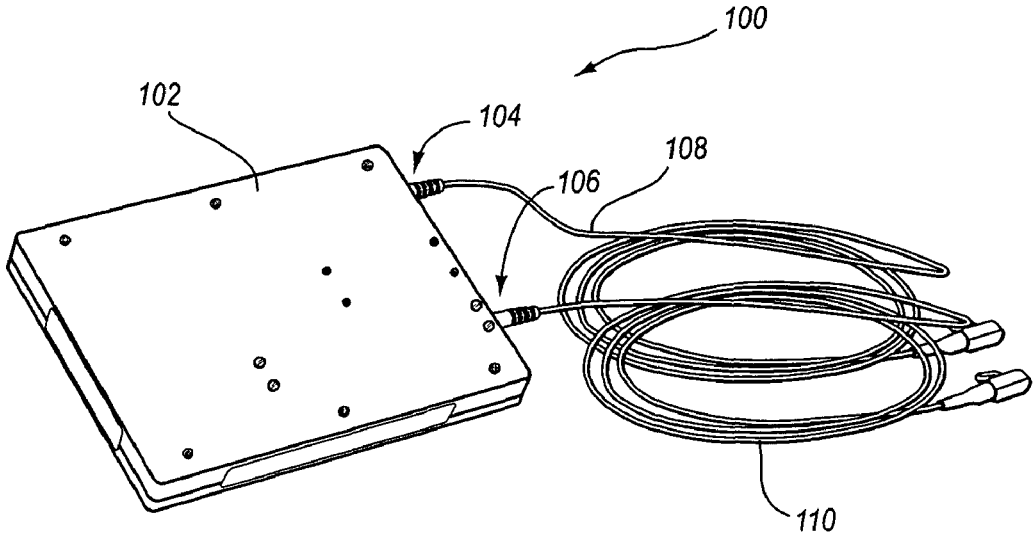
FIG. 1 is a perspective view of an example transponder.

With reference first to FIG. 1, an example transponder 100 is disclosed. The example transponder 100 is one environment in which the example hybrid surface mountable packages disclosed herein can be employed. The example transponder 100 includes a housing 102, a transmit port 104 defined in the housing 102, and a receive port 106 defined in the housing 102. As disclosed in FIG. 1, fiber optic cables 108 and 10 can be received into port 104 and 106, respectively.

The example transponder is substantially compliant with the 40 G 300 pin MSA. It is noted, however, that the example hybrid surface mountable packages disclosed herein are not limited to employment in high-speed or very-high-speed transponders, but can also be employed in any environment where hybrid surface mountable packages with multiple co-packaged MICs would be beneficial. For example, any other transceiver or transponder that operates at about 40 Gbps or above can employ the example hybrid surface mountable packages disclosed herein.

II. First Example Hybrid Surface Mountable Package

Figure 2:
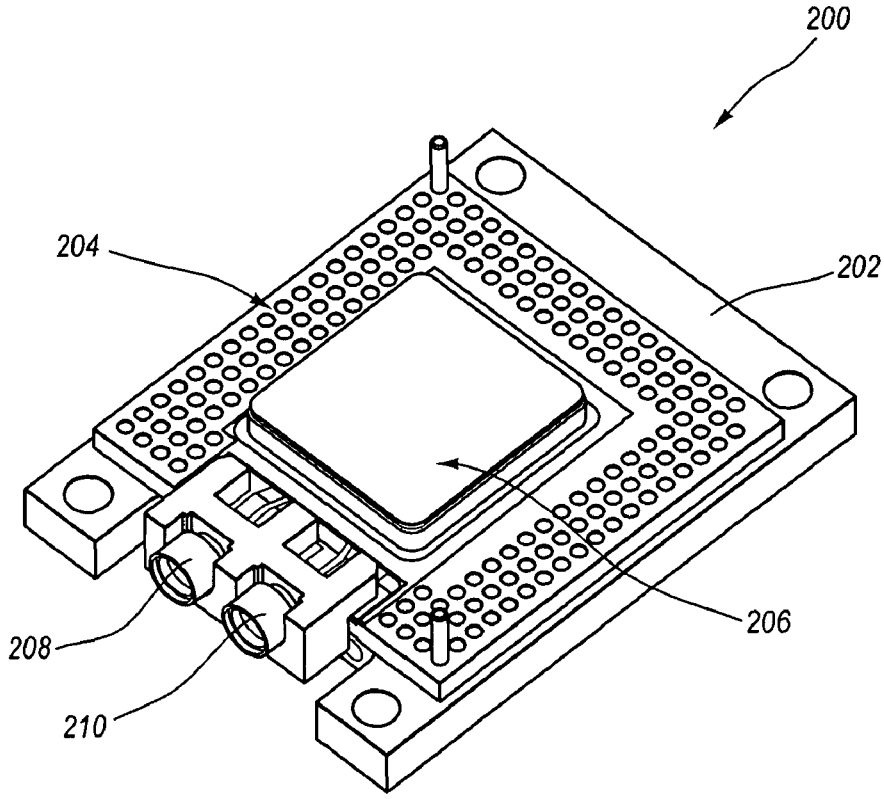
FIG. 2 is a perspective view of an example hybrid surface mountable package that can be included within the example transponder of FIG. 1.

With reference now to FIG. 2, an example hybrid surface mountable package 200 is disclosed. As disclosed in FIG. 2, the example hybrid surface mountable package 200 includes a board 202 and a grid array 204, a housing 206, a transmit microwave connector 208, and a receive microwave connector 210 all mounted to the board 202.

Figure 3:
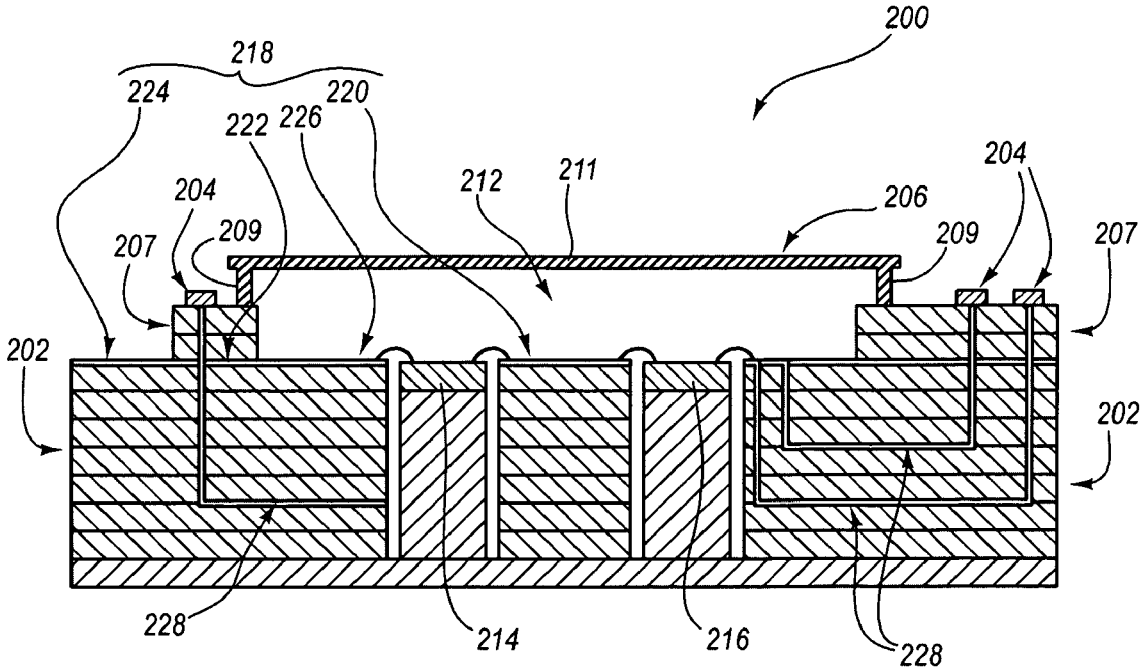
FIG. 3 is a section view of a portion of the example hybrid surface mountable package of FIG. 2.

With reference now to FIG. 3, additional aspects of the example hybrid surface mountable package 200 are disclosed. As disclosed in FIG. 3, the housing 206 of the hybrid surface mountable package 200 at least partially defines a sealed cavity 212. The housing 206 may include a ceramic interposer 207 that sits on top of the board 202, and a metal seal ring 209 is brazed to the ceramic interposer 207. The metal seal ring 209 allows for a metal lid 211 to be brazed and form a housing 206 that at least partially defines a hermetically sealed cavity 212. The housing 206 may also provide electromagnetic radiation shielding and protection from damage.

Two MIC chips 214 and 216 are positioned inside the sealed cavity 212. The MIC chips 214 and 216 are thus co-packaged in a single sealed cavity 212, as disclosed in FIG. 3. The very-high-speed interconnects of FIG. 3 may enable the MICs 214 and 216 to operate at data rates at least as high as 40 Gbps. For example, very-high-speed signals, such as 40 Gbps signals, can travel between the MIC chip 214 and the MIC chip 216, and from MIC chip 214 to microwave connectors 208 and 210 (see FIG. 2) via a very-high-speed interconnect 218.

The very-high-speed interconnect 218 includes first strong coupling co-planar waveguide (CPWG) transmission lines 220 which connect the two MIC chips 214 and 216 to each other. The very-high-speed interconnect 218 also includes a strong coupling wall feed thru 222 extending through the housing 206, second strong coupling CPWG transmission lines 224 connecting the feed thru 222 to the microwave connectors 208 and 210 (see FIG. 2), and third strong coupling CPWG transmission lines 226 connecting the feed thru 222 to the MIC chip 214. The feed thru 222, which may include a buried strip line under the ceramic interposer 207, may substantially prevent radiation from emanating from the feed thru 222. The strong coupling CPWG transmission lines 220, 224, and 226 may help confine electromagnetic radiation near the signal plane and also help to eliminate spurious modes at the operating frequency range of the MIC chips 214 and 216.

Also disclosed in FIG. 3 is the grid array 204 positioned outside the sealed cavity 212, and high-speed interconnects 228 between the grid array 204 and the MIC chips 214 and 216. While the very-high-speed interconnect 218 is capable of data rates at least as high as 40 Gbps, the high-speed interconnects 228, which are routed through multiple layers of the board 202, are only configured to carry data signals at data rates that are less than about 25 Gbps. The high-speed interconnects 228 may also be configured to carry power, ground, and other DC signals. The difference in physical features between the high-speed interconnects 118 and the high-speed interconnects 228 will be discussed below in connection with FIGS. 4A-7B.

Also disclosed in FIG. 3 are additional aspects of the board 202. The very-high-speed interconnects 218 and the high-speed interconnects 228 are integrated into the board 202, which may be a multilayer ceramic board. The multiple ceramic layers of the board 202 may be produced from ceramic materials and processing such as high temperature co-fired ceramic (HTCC) or low temperature co-fired ceramic (LTCC) materials, although these layers may be produced from other materials and/or other processes.

Figure 4A:
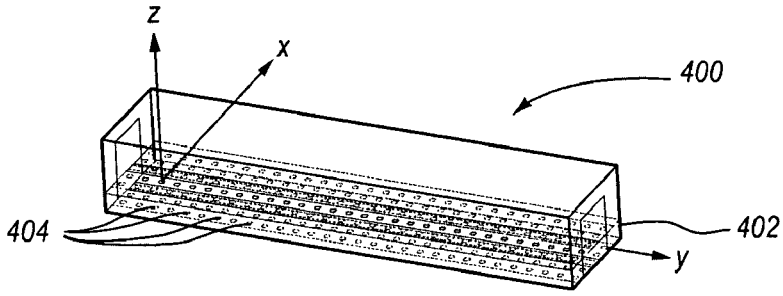
FIGS. 4A-4C are various views of an example strong coupling co-planar waveguide (CPWG) transmission line.
Figure 4B:
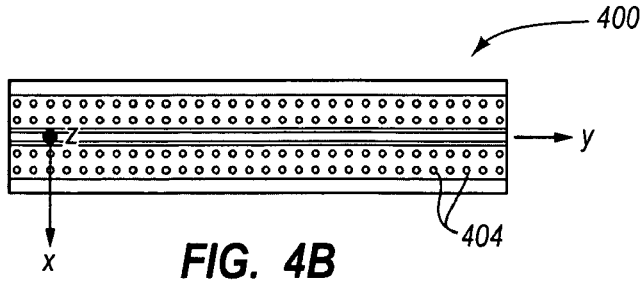
Figure 4C:
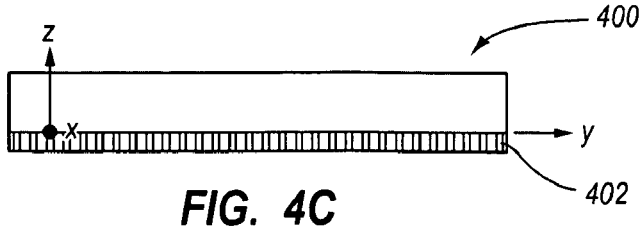

FIGS. 4A-4C disclose aspects of an example strong coupling CPWG transmission line 400. The example CPWG transmission line 400 uses about 500 um thick HTCC material as a dielectric layer 402 with a dielectric constant of about 9.2 and tangent loss of about 0.00015. It is understood that this configuration of the dielectric layer 402 is only one example configuration. Other dielectric layers with various configurations can instead be employed in connection with the CPWG transmission line 400.

The dielectric layer 402 also includes ground vias 404 positioned along the transmission line. The ground vias 404 can help to confine the electric field, maintain fundamental mode, and eliminate the spurious modes. The ground vias 404 may be connected to the side grounds and bottom grounds in the CPWG transmission line 400. The ground vias 404 can be formed using a drilling process and may be gold plated. The RF performance of the CPWG transmission line 400 can be improved by optimizing the locations and sizes of the ground vias 404. For example, in some example embodiments the ground vias 404 may be positioned in double rows on each side of the transmission line with about 0.4 mm of space between each via in each row, and between the rows. 0.4 mm is about 1/10 of the shortest wavelength of highest operating frequency 40 GHz.

Figure 5A:
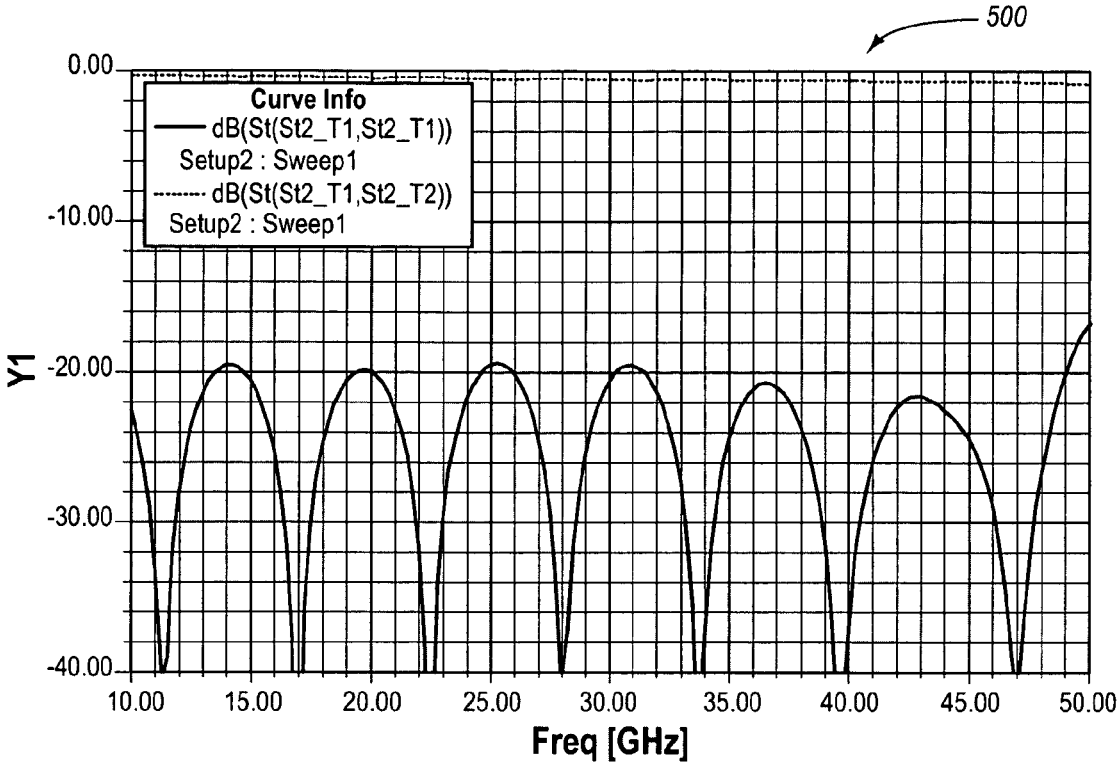
FIG. 5A is a chart of S-parameters test results on a simulation of the strong coupling CPWG transmission line of FIGS. 4A-4C.
Figure 5B:
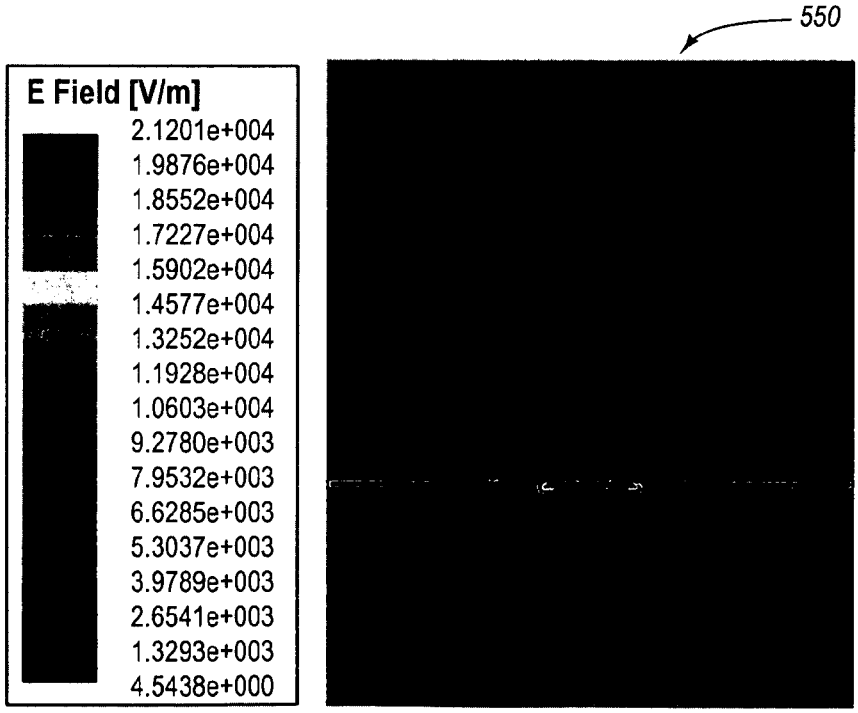
FIG. 5B is a chart of field distribution test results on a simulation of the strong coupling CPWG transmission line of FIGS. 4A-4C.

FIG. 5A discloses S-parameters test results 500 on a simulation of the strong coupling CPWG transmission line of FIGS. 4A-4C. The S-parameters test is used to characterize scattering parameters in high-frequency circuits. FIG. 5B discloses field distribution test results 550 on a simulation of the strong coupling CPWG transmission line of FIGS. 4A-4C. These results 500 and 550 show that a strong coupling has the electromagnetic field confined near the signal plane without radiation, thus eliminating spurious modes and cavity resonances below about 40 GHz. In this example, the strong coupling is achieved with a trace width of about 0.2 mm with an about 0.095 mm gap between traces.

Figure 6A:
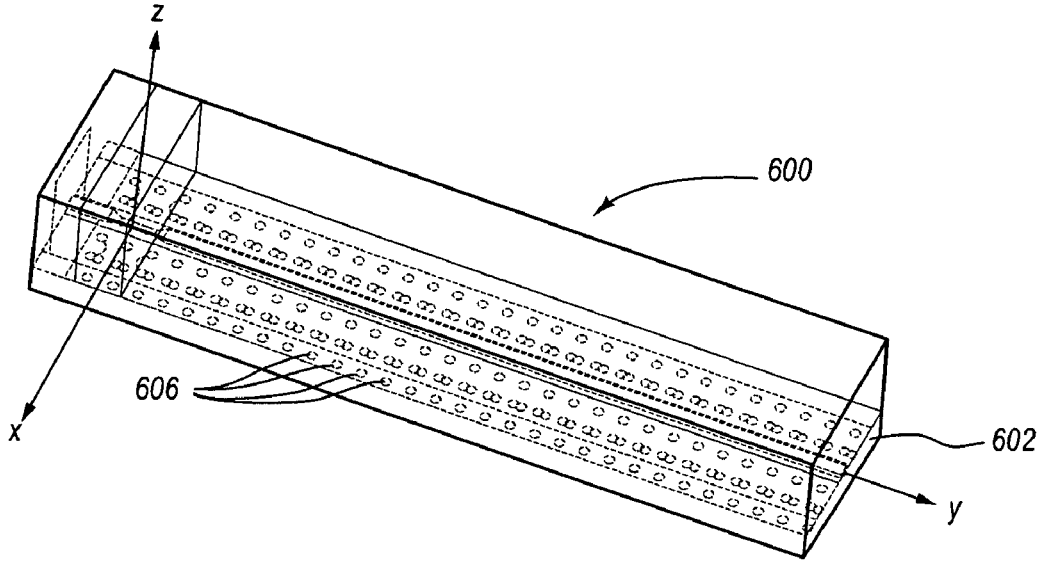
FIGS. 6A-6C are various views of an example strong coupling wall feed thru transmission line.
Figure 6B:
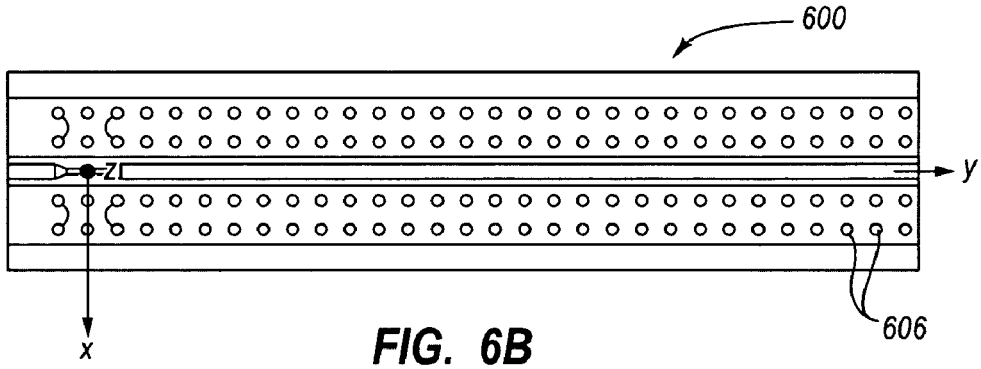
Figure 6C:
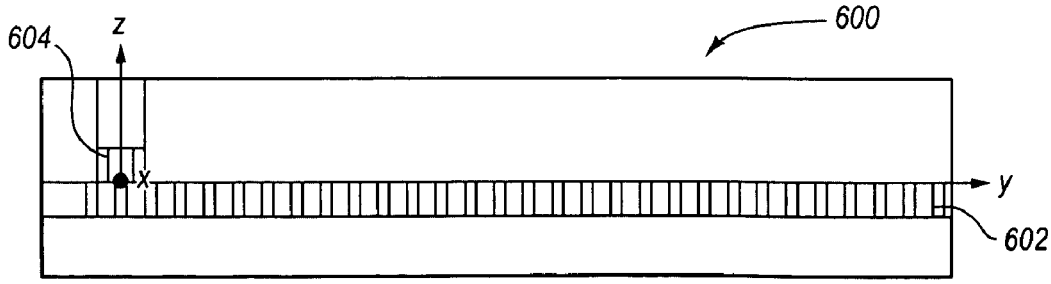

FIGS. 6A-6C disclose aspects of an example strong coupling wall feed thru transmission line 600. The example strong coupling wall feed thru transmission line 600 uses about 500 um thick HTCC material as a dielectric layer 602 with a dielectric constant of about 9.2 and tangent loss of about 0.00015. The example strong coupling wall feed thru transmission line 600 also uses a ceramic interposer 604 that sits on top of the dielectric layer 602 and under which the example strong coupling wall feed thru transmission line 600 extends. It is understood that this configuration of the dielectric layer 602 is only one example. Other dielectric layers with various configurations can instead be employed in connection with the strong coupling wall feed thru transmission line 600. The dielectric layer 602 also includes ground vias 606 positioned along the transmission line. The ground vias 606 may be similar to the ground vias 404 of FIGS. 4A-4C.

Figure 7A:
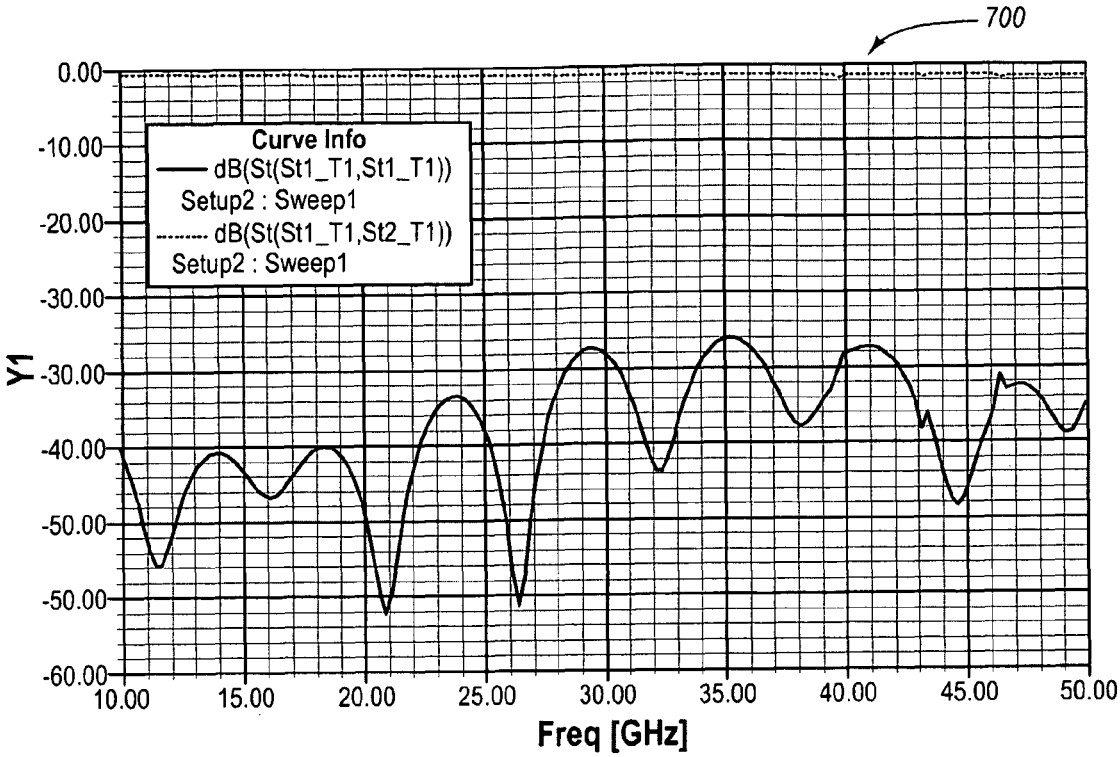
FIG. 7A is a chart of S-parameters test results on a simulation of the strong coupling feed thru transmission line of FIGS. 6A-6C.
Figure 7B:
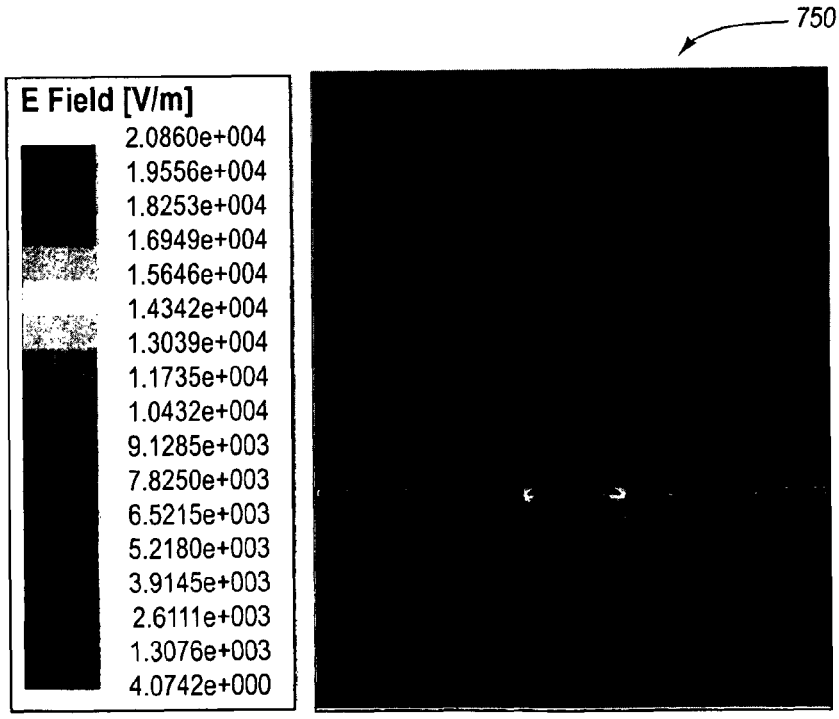
FIG. 7B is a chart of field distribution test results on a simulation of the strong coupling feed thru transmission line of FIGS. 6A-6C.

FIG. 7A discloses S-parameters test results 700 on a simulation of the strong coupling wall feed thru transmission line of FIGS. 6A-6C. FIG. 7B discloses field distribution test results 750 on a simulation of the strong coupling wall feed thru transmission line of FIGS. 6A-6C. These results show that a strong coupling has the electromagnetic field confined near signal plane without radiation, thus eliminating spurious modes and cavity resonances below about 40 GHz. In this example, a strong coupling is achieved with a trace width of about 0.2 mm with an about 0.095 mm gap between traces, and a trace width at strip line of about 0.09 mm.

Figure 8C:
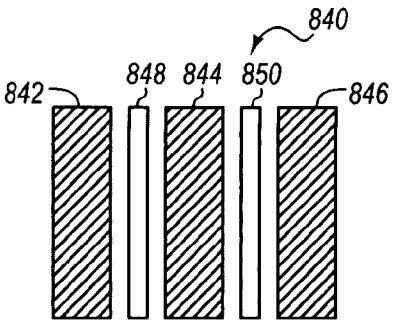
FIG. 8C is a top view of a transmission line having a ground-signal-ground-signal-ground (GSGSG) structure.
Figure 8B:
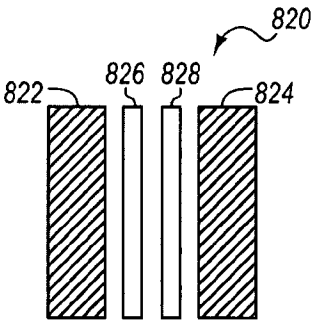
FIG. 8B is a top view of a transmission line having a ground-signal-signal-ground (GSSG) structure.
Figure 8A:
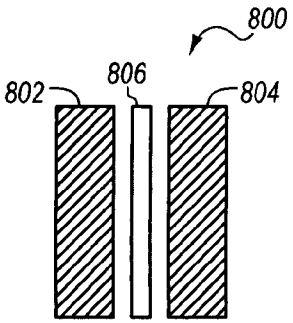
FIG. 8A is a top view of a transmission line having a ground-signal-ground (GSG) structure.

With reference now to FIGS. 8A-8C, aspects are disclosed of example transmission lines 800, 820, and 840. The example transmission line 800 has a ground-signal-ground (GSG) structure with ground lines 802 and 804 surrounding signal line 806, The example transmission line 820 has a ground-signal-signal-ground (GSSG) structure with ground lines 822 and 824 surrounding signal lines 826 and 828. The example transmission line 840 has a ground-signal-ground-signal-ground (GSGSG) structure with ground lines 842, 844, and 846 interleaved with signal lines 848 and 850.

The example transmission lines for very-high-speed interconnects disclosed herein may be configured for single-ended signals with a GSG structure. However, the very-high-speed interconnects disclosed herein may also be configured for differential pair signals with a GSSG structure or GSGSG structure. A strong coupling for GSG, GSSG, or GSGSG structures can be designed to minimize radiation and eliminate cavity resonances and spurious modes that may occur due to a large cavity dimension or long transmission lines. In order to achieve a strong coupling in the GSSG structure of the example transmission line 820, a relatively small gap, such as an about 0.095 mm gap, is required between signal traces 822 and 824 and ground traces 826 and 828 and also between the positive signal trace 826 and the negative signal trace 828.

III. Second Example Hybrid Surface Mountable Package

Figure 9:
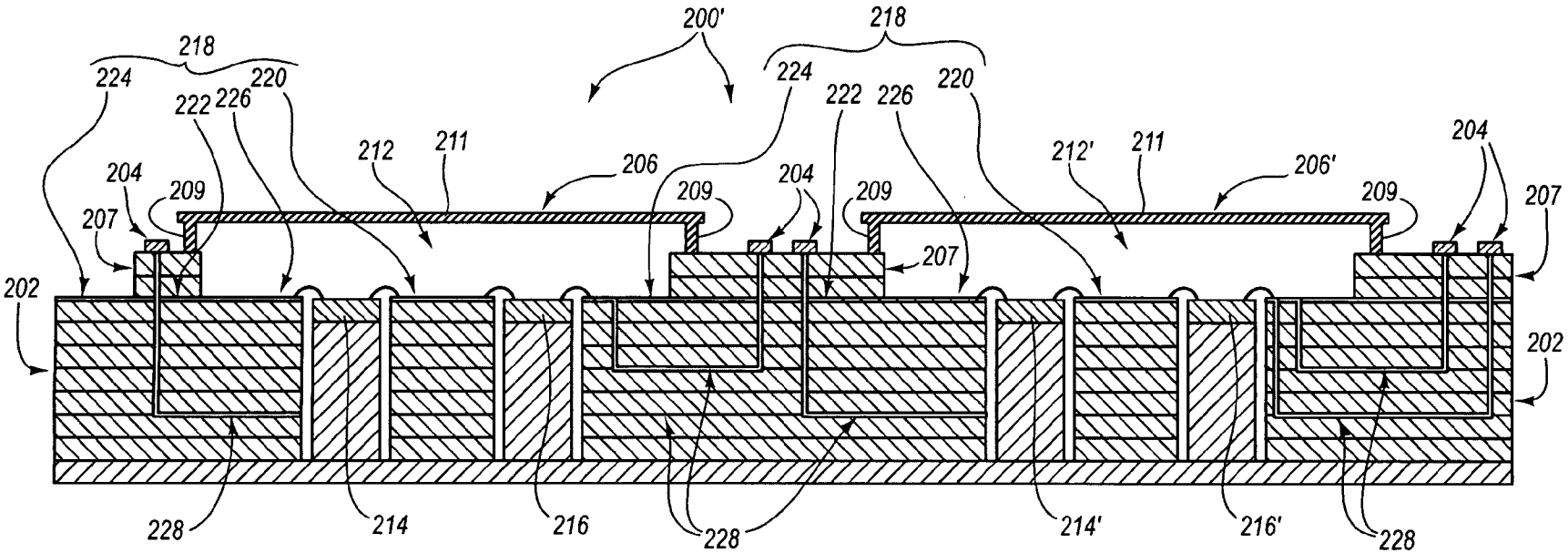
FIG. 9 is a section view of a portion of another example hybrid surface mountable package.

With reference now to FIG. 9, another example hybrid surface mountable package 200' is disclosed. As disclosed in FIG. 9, the example hybrid surface mountable package 200' is similar to the example hybrid surface mountable package 200, except that the example hybrid surface mountable package 200' additionally includes a second housing 206' at least partially defining a second sealed cavity 212', respectively. The second sealed cavity 212' has two MIC chips 214' and 216' positioned inside the second sealed cavity 212'. In addition, the example hybrid surface mountable package 200' includes a strong coupling wall feed thru 230 connecting the MIC chip 216' and the MIC chip 214'.

IV. Example Strong Coupling Configurations

In general, the operation frequency range for a feed thru is limited by spurious modes, which cause the loss dips at their resonance frequencies. The spurious modes in a feed thru can be generated due to the mode transition from a CPWG transmission line and a strip line under a wall. A feed thru with a strong coupling can be to eliminate the spurious modes in the operating frequency range. A strong coupling is achieved by using relatively small gaps and trace widths and by using relatively dense ground vias.

For example, in a CPWG transmission line, the smaller the gap and trace width, the stronger the coupling between signal trace and side ground to make the electric field concentrated near the gap. For a given dielectric material with a given dielectric constant and thickness, the gap map be determined by trace width for impedance match such as 50 ohm for a single-ended transmission line.

Figure 10A:
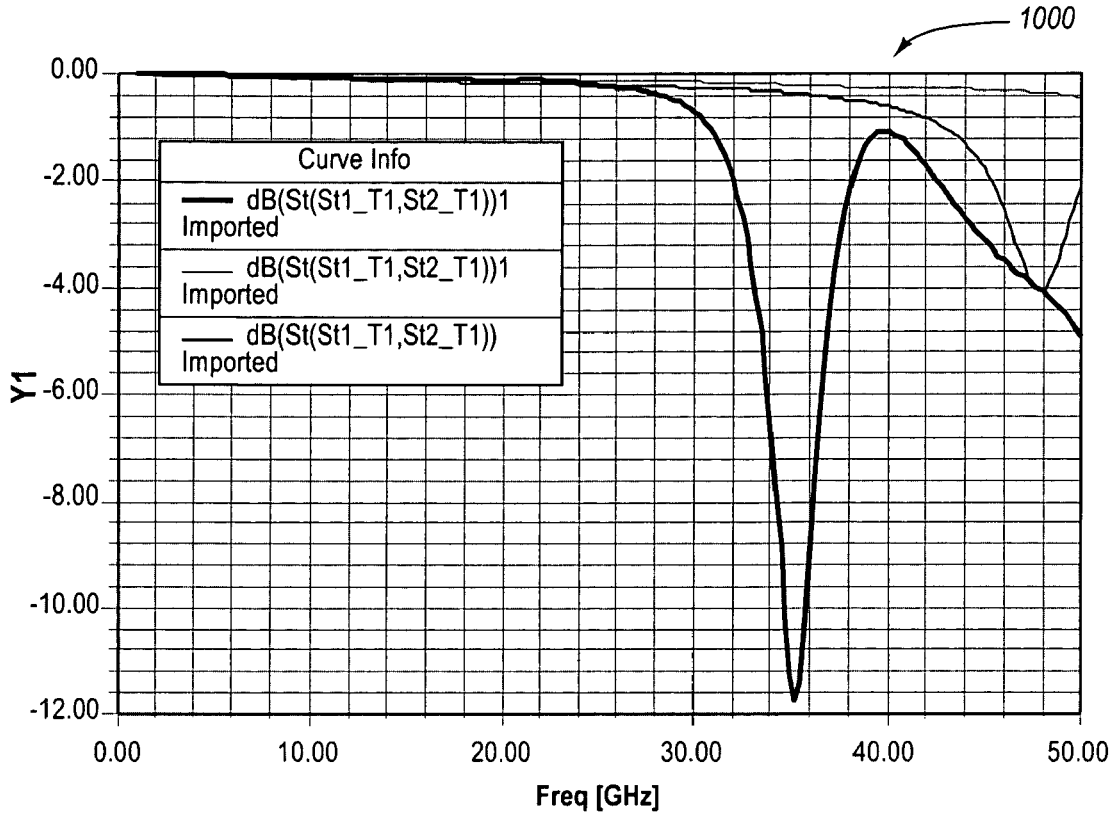
FIG. 10A is a chart of S21 responses of feed thrus having various gaps.

As disclosed in FIG. 10A, the S21 responses of feed thrus vary as the gaps of the feed thrus vary. For example, the thickest line represents a feed thru with a gap of about 0.35 mm, the medium thickness line represents a feed thru with a gap of about 0.18 mm, and the thinnest line represents a feed thru with a gap of about 0.095 mm. In the chart 1000 of FIG. 10A, the dips in the lines are caused by spurious modes. The structure of each feed thru is similar to the example strong coupling wall feed thru transmission line 600 of FIG. 6.

Figure 10B:
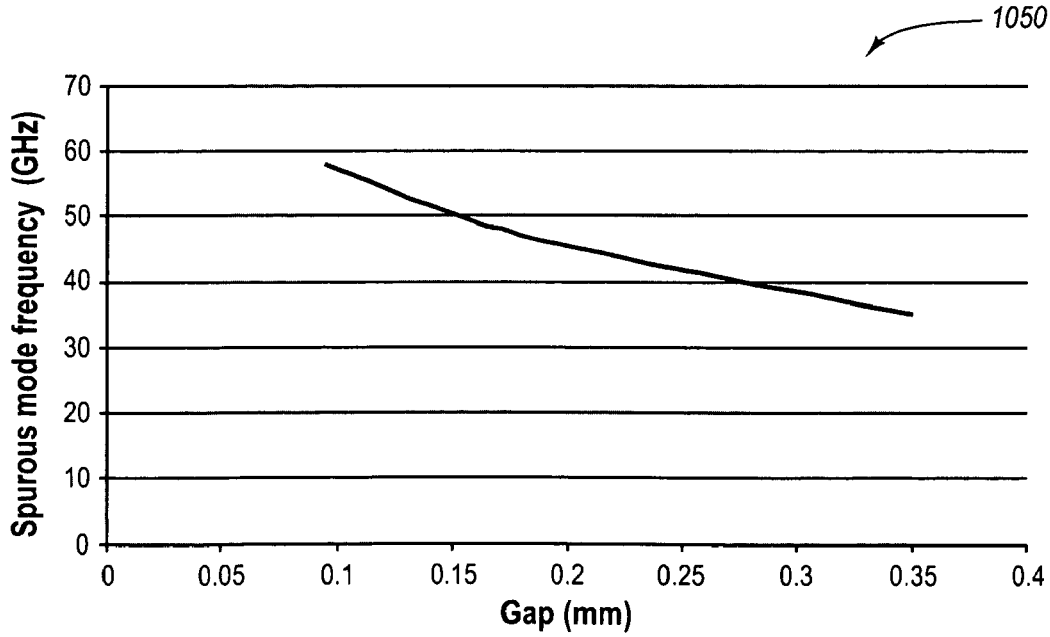
FIG. 10B is a chart of spurious mode frequencies of feed thru having various gaps.

As disclosed in the chart 1050 of FIG. 10B, the spurious mode frequencies of feed thrus vary as the gaps of the feed thrus vary. As disclosed in FIG. 10B, the smaller the gap, the stronger the coupling between signal trace and side grounds and thus the higher the spurious mode frequency. Therefore, for HTCC material with an about 9.2 dielectric constant and about 500 um thickness, for an about 40 Gb/s fiber optic link application, a strong coupling can be achieved by configuring a feed thru with a gap of about 0.18 mm or less, and a trace of about 0.3 mm or less. In some example embodiments using the same HTCC material, a strong coupling can be achieved by configuring a feed thru with a gap between about 0.095 mm and about 0.18 mm and a trace between about 0.2 mm and about 0.3 mm.

What is claimed is:

1. A hybrid surface mountable package comprising:

a housing at least partially defining a sealed cavity;

two microwave integrated circuits (MIC) chips positioned inside the sealed cavity; and a very high-speed interconnect connecting the MIC chips to each other, the very high-speed interconnect comprising strong coupling co-planar waveguide (CPWG) transmission lines, wherein the CPWG transmission lines are integrated into a multilayer ceramic board and each layer of the multilayer ceramic board is a high temperature co-fired ceramic (HTCC) having a thickness of about 500 um.

2. The hybrid surface mountable package as recited in claim 1, wherein the width of a trace in the CPWG transmission lines is between about 0.2 mm and about 0.3 mm.

3. The hybrid surface mountable package as recited in claim 1, wherein the width of a gap between traces in the CPWG transmission lines is between about 0.095 mm and about 0.18 mm.

4. A hybrid surface mountable package comprising:

a housing at least partially defining a sealed cavity;

two MIC chips positioned inside the sealed cavity;

two microwave connectors positioned outside the cavity; and a very high-speed interconnect connecting the MIC chips to the microwave connectors, the very high-speed interconnect comprising:

a strong coupling wall feed thru extending through the housing;

first strong coupling CPWG transmission lines connecting the feed thru to the microwave connectors; and second strong coupling CPWG transmission lines connecting the feed thru to the MIC chips, wherein the CPWG transmission lines are integrated into a multilayer ceramic board, with each layer of the multilayer ceramic board being formed from a HTCC having a thickness of about 500 um, a dielectric constant of about 9.2, and a tangent loss of about 0.00015.

5. The hybrid surface mountable package as recited in claim 4, further comprising:

a grid array positioned outside the cavity; and a high-speed interconnect between the grid array and the MIC chips.

6. The hybrid surface mountable package as recited in claim 4, wherein the width of a trace in the CPWG transmission lines is between about 0.2 mm and 0.3 mm and the width of a gap between traces in the CPWG transmission lines is between about 0.095 mm and about 0.18 mm.

7. The hybrid surface mountable package as recited in claim 4, wherein the width of a trace in the feed thru is about 0.09 mm and the width of a gap between traces in the feed thru is about 0.095 mm.

8. The hybrid surface mountable package as recited in claim 4, wherein the very high-speed interconnect comprises a ground-signal-ground (GSG) structure configured to carry single-ended signals.

9. A hybrid surface mountable package comprising:

a first housing at least partially defining a first sealed cavity;

a second housing at least partially defining a second sealed cavity;

first MIC chips positioned inside the first sealed cavity;

second MIC chips positioned inside the second sealed cavity;

two microwave connectors positioned outside the cavity; and a very high-speed interconnect connecting the MIC chips to the microwave connectors, the very high-speed interconnect comprising:

a first strong coupling wall feed thru connecting the first MIC chips and the second MIC chips through the first housing and the second housing;

a second strong coupling wall feed thru extending through the second housing;

first strong coupling CPWG transmission lines connecting the second feed thru to the microwave connectors; and second strong coupling CPWG transmission lines connecting the second feed thru to the second MIC chips, wherein the CPWG transmission lines are integrated into a multilayer ceramic board, with each layer of the multilayer ceramic board being formed from a HTCC having a thickness of about 500 um, a dielectric constant of about 9.2, and a tangent loss of about 0.00015.

10. The hybrid surface mountable package as recited in claim 9, further comprising:

a grid array positioned outside the cavity that is configured to carry high-speed, power, and ground signals; and a high-speed interconnect between the grid array and the first and second MIC chips.

11. The hybrid surface mountable package as recited in claim 9, wherein the width of a trace in the CPWG transmission lines is about 0.2 mm and the width of a gap between traces in the CPWG transmission lines is about 0.095 mm.

12. The hybrid surface mountable package as recited in claim 9, wherein the width of a trace in the feed thru is about 0.09 mm and the width of a gap between traces in the feed thru is about 0.095 mm.

13. The hybrid surface mountable package as recited in claim 9, wherein the very high-speed interconnect comprises a GSG structure configured to carry single-ended signals.

* * * * *